US006819886B2

(12) United States Patent
Runkowske et al.

(10) Patent No.: US 6,819,886 B2
(45) Date of Patent: Nov. 16, 2004

(54) GLOSS/DENSITY MEASUREMENT DEVICE WITH FEEDBACK TO CONTROL GLOSS AND DENSITY OF IMAGES PRODUCED BY AN ELECTROGRAPHIC REPRODUCTION APPARATUS

(75) Inventors: Holger Runkowske, Fahren (DE); Jan Dirk Boness, Bad Bramstedt (DE); Muhammed Aslam, Rochester, NY (US); Eric K. Zeise, Pittsford, NY (US)

(73) Assignee: Nex Press Solutions LLC, Rochester, NY (US)

( * ) Notice: Subject to any disclaimer, the term of this patent is extended or adjusted under 35 U.S.C. 154(b) by 0 days.

(21) Appl. No.: 10/625,429

(22) Filed: Jul. 23, 2003

(65) Prior Publication Data

US 2004/0141764 A1 Jul. 22, 2004

Related U.S. Application Data

(60) Provisional application No. 60/420,514, filed on Oct. 23, 2002.

(51) Int. Cl.[7] ..... G03G 15/00

(52) U.S. Cl. ..... 399/38; 399/67; 399/69

(58) Field of Search ..... 219/216; 399/38, 399/67, 69, 328, 329, 331, 341; 430/97, 124

(56) References Cited

U.S. PATENT DOCUMENTS 6,535,712 B2 * 3/2003 Richards ..... 399/341
6,549,746 B2 * 4/2003 Hauptmann ..... 399/341
6,661,993 B2 * 12/2003 Bartscher et al. ..... 399/341

* cited by examiner

*Primary Examiner*—Huang Ngo
(74) *Attorney, Agent, or Firm*—Lawrence P. Kessler

(57) ABSTRACT

An on-line gloss/density meter for an electrostatographic reproduction apparatus in which pigmented marking particle images are fixed to receiver members respectively by application of heat and/or pressure as such receiver members travel along a transport path through a fuser assembly. The on-line gloss/density meter includes at least one light emitter and at least one light collector, respectively mounted in operative association with the transport path so that light from the emitter, reflected from a receiver member, and is detected and a signal corresponding to such reflected light is produced. A guide element is associated with the transport path and directs a receiver member into a predetermined specified location relative to the beam of light. A logic and control unit, responsive to signals from the light collector, precisely controls operating parameters for the electrostatographic reproduction apparatus.

19 Claims, 8 Drawing Sheets

GLOSS/DENSITY MEASUREMENT DEVICE WITH FEEDBACK TO CONTROL GLOSS AND DENSITY OF IMAGES PRODUCED BY AN ELECTROGRAPHIC REPRODUCTION APPARATUS

This application claims benefit of U.S. Provisional 60/420,514 filed Oct. 23, 2002.

FIELD OF THE INVENTION

This invention relates in general to gloss and density control for fused marking particle images produced by electrographic reproduction apparatus, and more particularly to gloss and density control of electrographic reproduction apparatus marking particle images fused to a substrate, such control being based on gloss/density parameters determined by an on-line gloss/density meter and fed back to the reproduction apparatus logic and control unit.

BACKGROUND OF THE INVENTION

In electrographically reproducing information on substrates (commonly referred to as receiver members), a suitable colorant is laid down on a receiver member, in an image-wise pattern, and then permanently fixed to the receiver member. The colorant is generally, for example, a colored ink or a set of pigmented marking particles. After the image is fixed to the receiver member, it exhibits a distinctive reflection characteristic commonly referred to as gloss. The plain surface of the receiver member itself also exhibits a unique gloss. In order to maximize the acceptability of the electrographic reproductions, control of the gloss of the marking particle image is desirable. For example, at times it is desirable to match the gloss of the marking particle image to the gloss of the receiver member.

There are three prominent standards that describe the measurement of gloss: The German DIN 67530, the International ISO/DIS 2813/8254, and ASTM D 523. From the experimental setup, they differ slightly, but essentially, they are based on a few fundamental principles. Gloss by definition is measured in reflection geometry. When a sample is very smooth and reflects well (which is equivalent to high gloss) most reflected light is contained within the direct specular beam while only a small part of the intensity is reflected as a diffused light. The ratio of specular to diffuse light varies with the gloss. When most light is reflected diffusely, the sample is perceived as low gloss (matte).

Most commercially available gloss meters, in determining gloss, reflect light from a marking particle image bearing receiver member, and measure the diffuse component of the reflected light by blocking the specular component of such reflected light. To obtain a sufficient signal-to-noise ratio for suitable effective gloss meter measurement, such gloss meters often employ the bright white illumination provided by a Xenon flash lamp. The resulting measurement can then be quite accurate, but is relatively slow, with cycle times measured in seconds.

Typically, the suitable standard for measuring gloss is described as directing a light beam at a sample (substrate), blocking the specular beam and only detecting the diffused light around it with a conventional light sensor. While this setup provides an excellent dynamic range, it has proven to lead to a very high sensitivity of the signal to the position of the sample relative to the sensor (i.e., if the distance to the sample varies just slightly from a preselected distance, part of the specular beam is unblocked and detected in addition to the diffused light). The accuracy required by such a standard is clearly extremely difficult to obtain, and has previously only been achievable with a table-top (off-line) sensor.

SUMMARY OF THE INVENTION

In view of the above, it is the purpose of this invention to provide for gloss/density measurements of a marking particle image produced on a receiver member in an electrographic reproduction apparatus, on line, such that meaningful feedback for the reproduction apparatus can be obtained to control gloss/density of the reproduced image. The on-line gloss/density meter includes at least one light emitter for emitting a collimated light beam, the emitter mounted in operative association with the transport path, preferably substantially immediately downstream, in the direction of receiver member travel, from the fuser assembly. At least one light collector, mounted in operative association with the at least one light emitter and the transport path detects light from the at least one emitter, reflected from a receiver member transported along the transport path, and produces a signal corresponding to such reflected light. A guide element is associated with the transport path and directs a receiver member into a predetermined specified location relative to the beam of light from the at least one emitter to reflect light toward the at least one collector. A logic and control unit controlling operative parameters of the electrostatographic reproduction apparatus, responsive to signals from the at least one collector, precisely controls operating parameters for the electrostatographic reproduction apparatus to control gloss and/or density.

The invention, and its objects and advantages, will become more apparent in the detailed description of the preferred embodiment presented below.

BRIEF DESCRIPTION OF THE DRAWINGS

In the detailed description of the preferred embodiments of the invention presented below, reference is made to the accompanying drawings, in which.

DETAILED DESCRIPTION OF THE INVENTION

The purpose of this invention is to measure the gloss/density of pigmented marking particle images fused to receiver members (substrates) in electrographic reproduction apparatus, or any other form of images (produced, for example, by ink jet, thermal or offset printing), on-line (real time) using an on-line gloss/density meter during or between print jobs. The pigmented marking particles may (or may not) be covered with clear marking particles. The real time gloss/density measurements are fed back through the reproduction apparatus logic and control unit to the fuser assembly (or other electrographic process stations of the reproduction apparatus) to alter its operating parameters to more accurately match the gloss/density of the reproduced image to that of the receiver member, or any other desired gloss/density level. Feedback of data to electrographic reproduction apparatus logic and control unit is utilized to influence key process control parameters to ensure high quality and consistency of the produced reproductions.

As noted above, when a sample, such as a receiver member, is very smooth and reflects well (high gloss), most reflected light is contained within the direct specular beam, while only a small part of the intensity is reflected as a diffused light. The ratio of specular light to diffuse light varies with the gloss. Thus, as light is reflected more diffusely, the sample is perceived as being less glossy. According to this invention, an on-line gloss/density meter is described which uses the Germen DIN 67530 geometry. Of course, other geometries are suitable for use with an on-line gloss/density meter according to this invention.

Figure 1:
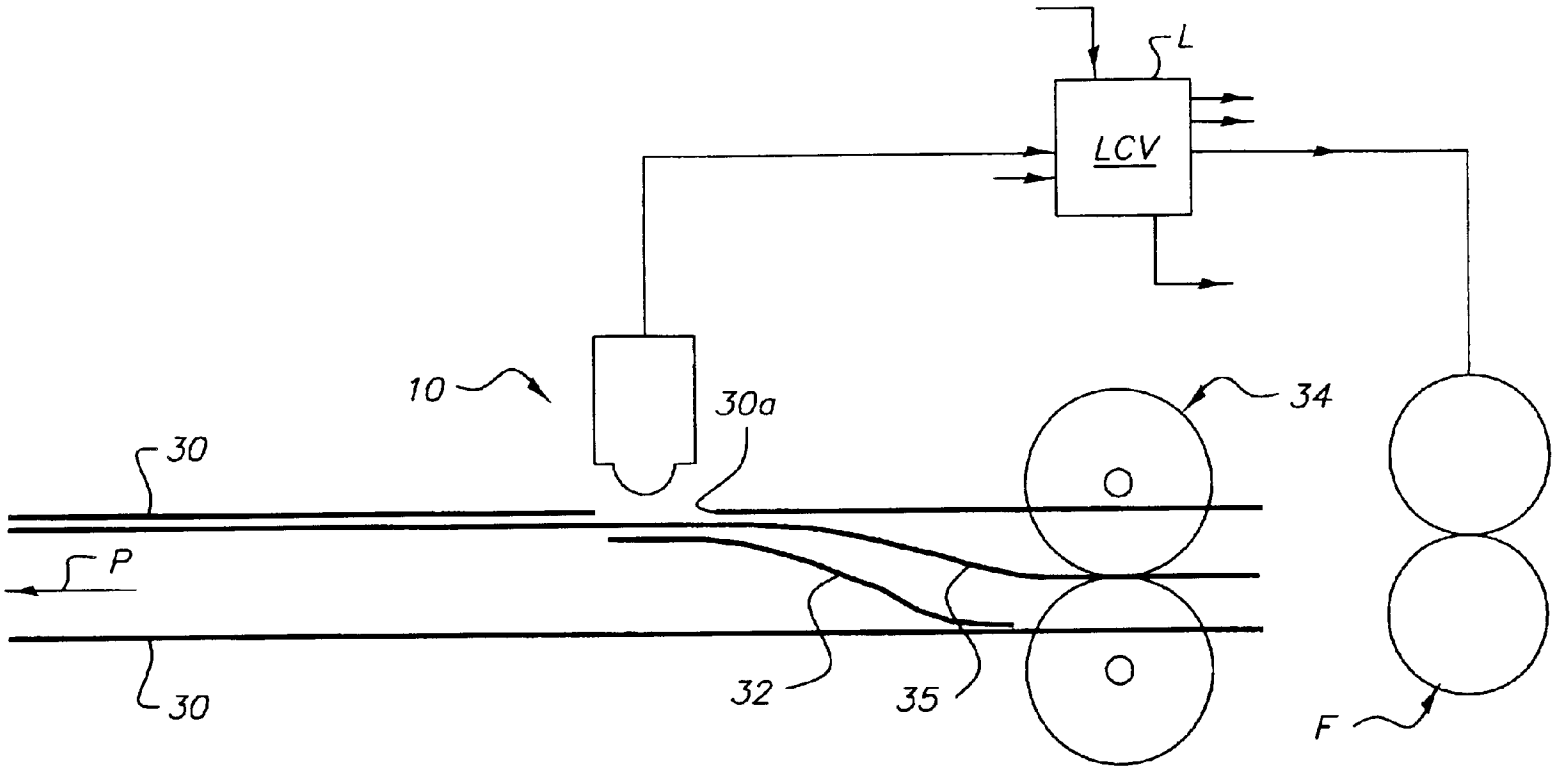
FIG. 1 is a schematic side elevational view of a portion of a receiver member transport path of an electrographic reproduction apparatus, including an on-line gloss/density meter according to this invention, with the on-line gloss/density meter positioned in the transport path downstream of the fuser assembly.

The on-line gloss/density meter, designated generally in the accompanying drawings by the numeral 10, is positioned adjacent to a receiver member (substrate) transport path P (see FIG. 1). The transport path P is defined for example by sheet metal plates or wire-form guides 30. A bronze leaf spring 32, or any other suitable urging member (e.g., spring steel), is mounted relative to the wire-form guides 30 of the transport path P so as to urge a receiver member (designated generally by the numeral 35) transported (for example by nip rollers 34) along the path P into a repeatable, accurate, predetermined spacing relative to the on-line gloss/density meter 10 through a suitable opening 30*a* in the wire-form guides 30 of the transport path.

Figure 5:
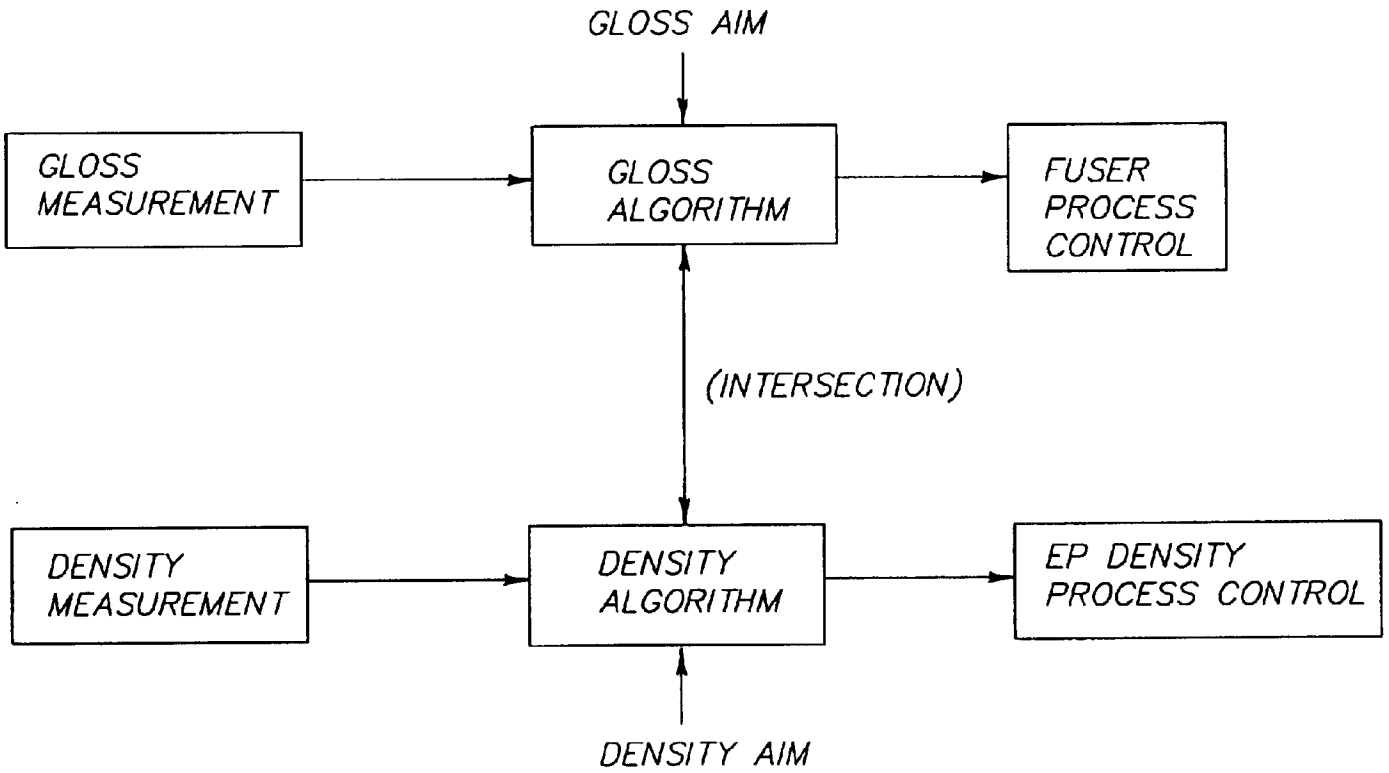
FIG. 5 is a block diagram of the function of the on-line gloss/density meter, according to this invention.

Preferably, the gloss/density meter 10 is located just downstream, in the direction of receiver member travel in the transport path P, of a fuser assembly F of any well known electrostatographic reproduction apparatus. For purposes of explanation of this invention, the reproduction apparatus is assumed to operate according to any well known electrographic process, and is controlled by any suitable, well known, microprocessor-based logic and control unit (designated in FIG. 1 by the letter L) to perform in the manner indicated in the block diagram of FIG. 5.

Figure 2A:
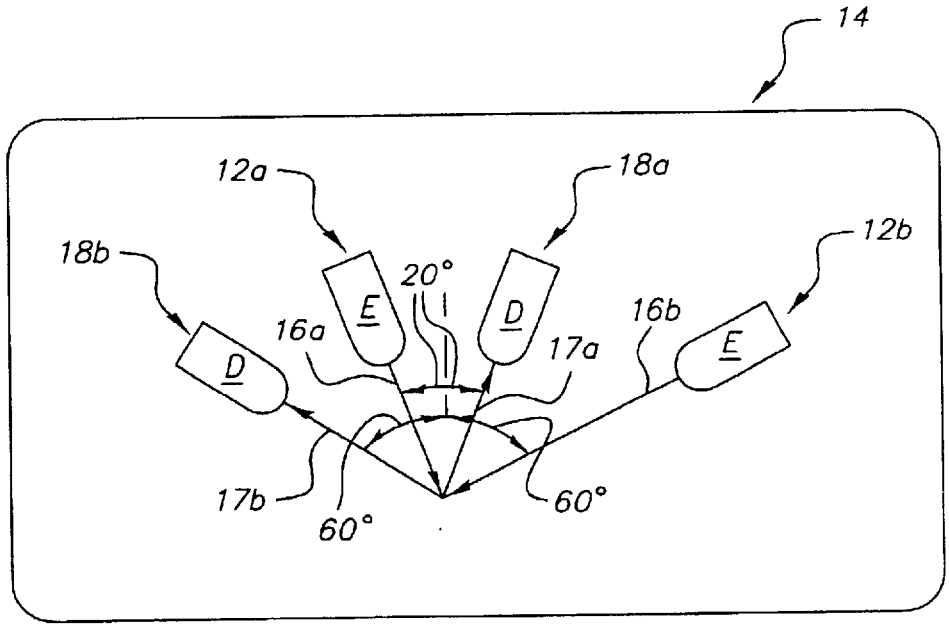
FIGS. 2*a*, 2*b*, and 2*c* are schematic side elevational views of on-line gloss/density meters, according to this invention, with respective different relative angular configurations.
Figure 2B:
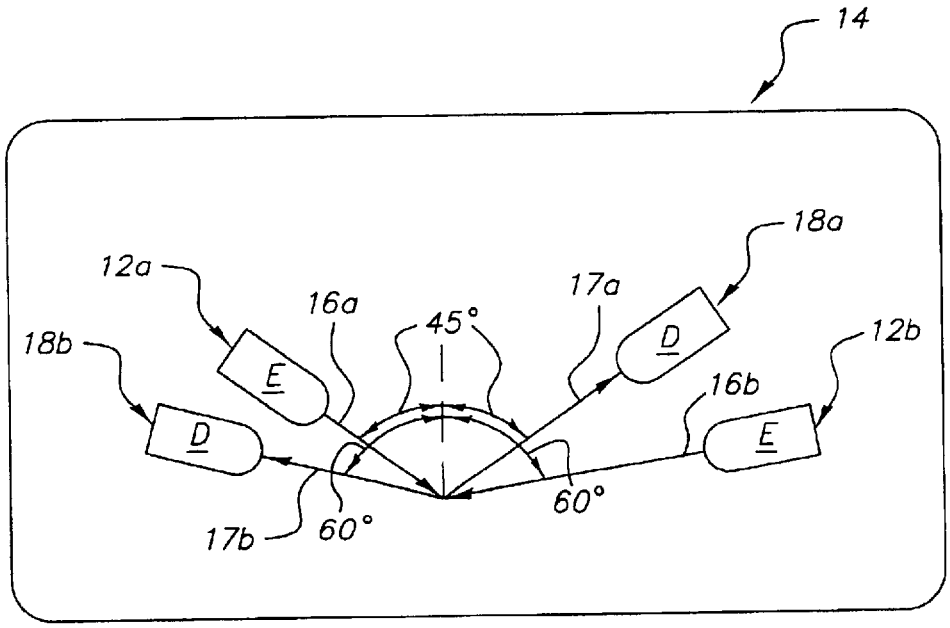
Figure 2C:
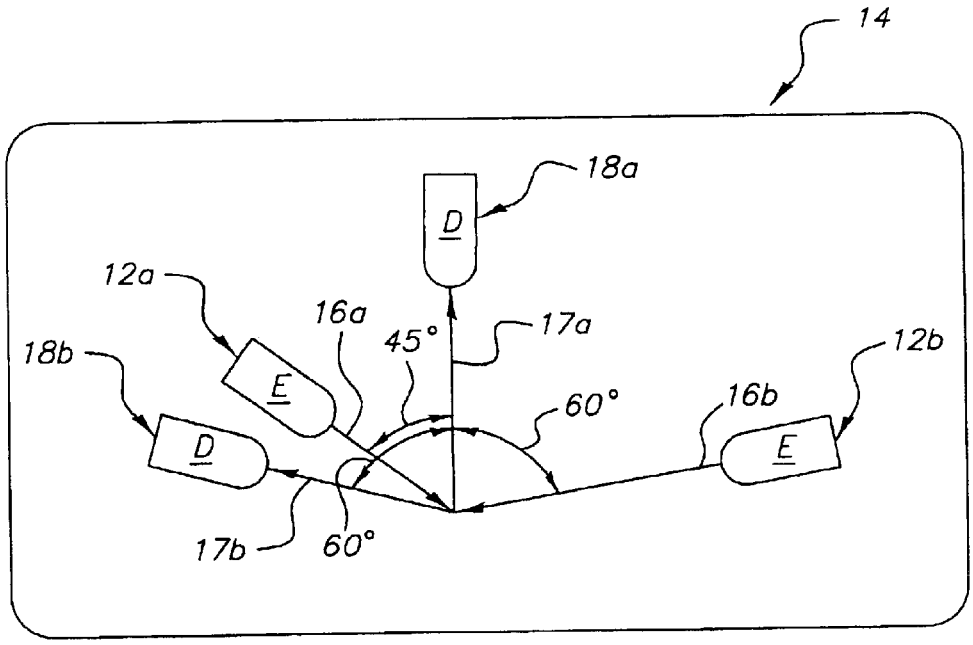

The on-line gloss/density meter 10, as shown respectively in FIGS. 2*a*, 2*b*, 2*c*, includes emitters 12*a*, 12*b*, providing respective collimated light beams 16*a*, 16*b*, adapted to be reflected (as indicated as beams 17*a*, 17*b*) from a marking particle image bearing receiver member 35. The reflected light beams 17*a*, 17*b*, are adapted to be collected by suitable light collector mechanisms 18*a*, 18*b*. A frame member 14 supports the emitters 12*a*, 12*b*, and the corresponding collectors 18*a*, 18*b* at predetermined angles for the purpose discussed more fully below. In the particular configurations shown in respective FIGS. 2*a*, 2*b*, 2*c*, the respective emitter/collector pairs (12*a*/18*a* and 12*b*/18*b*) are in respective angular orientation measured in degrees from the vertical. Of course, other angular orientations are suitable for use with this invention. Moreover, a single, particularly oriented emitter/collector pair may be utilized for measuring only gloss or density, as desired.

Figure 4:
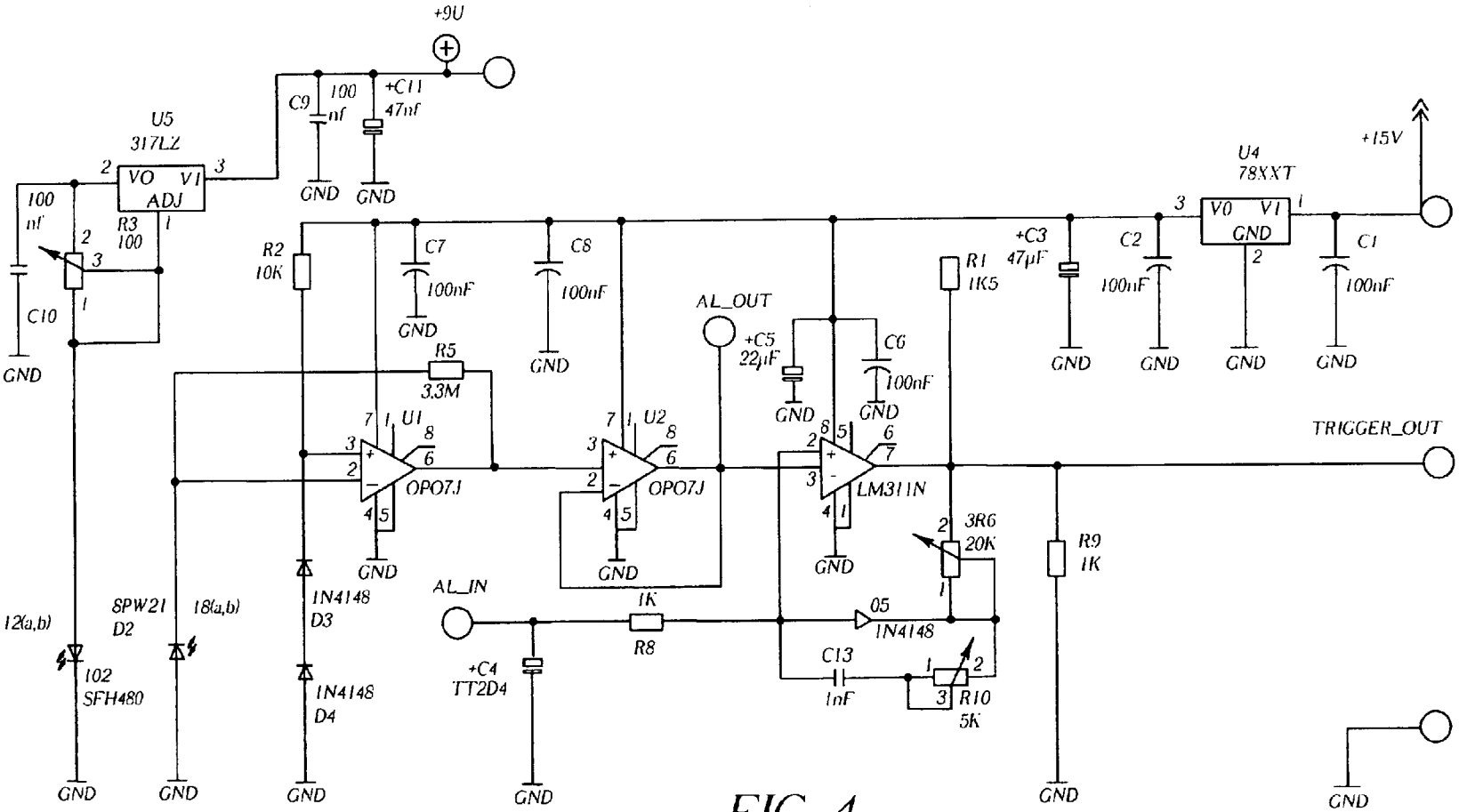
FIG. 4 is a diagrammatic illustration of a circuit diagram for the on-line gloss/density meter according to this invention.

The on-line gloss/density meter 10 according to this invention is arranged to detect the specular light beam, the intensity of which is higher for a glossy sample (receiver member/substrate) than for a matte sample (where diffused reflection in all directions prevails). A triggering software is used to recognize a sample, such as any well known pigmented marking particle (or inked) image, on a white receiver member. FIG. 4 shows, in detail, a particular preferred circuit diagram for the on-line gloss/density meter 10 according to this invention.

In well known conventional table-top gloss meters, a standard filament bulb is most commonly used for illumination. Such a bulb, however, only has a limited lifetime and contains very little radiation in the blue and ultraviolet (UV) region. Normally when a sample absorbs light strongly in the blue region of the spectrum, it is perceived as yellow; hence for measurements (i.e., for marking particle density, gloss, etc.) on yellow samples, blue light is necessary to distinguish between the marking particle patches and the plain white paper receiver member. Thus, it is hard to measure gloss on a yellow sample.

Figure 3A:
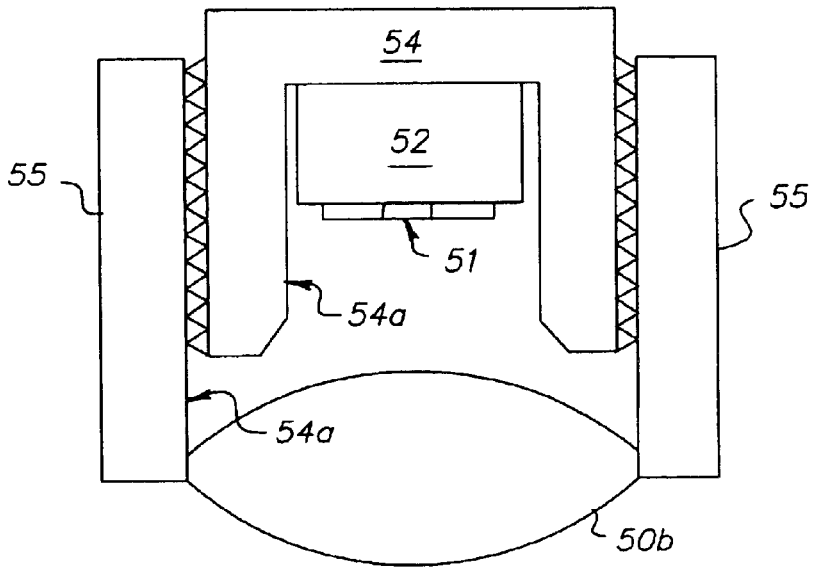
FIGS. 3*a* and 3*b* are respective schematic illustrations of light emitter and detector components of the on-line gloss/density meter according to this invention.

With the on-line gloss/density meter 10, according to this invention, the emitters 12*a*, 12*b* employ a white light LED 40 (see FIG. 3*a*). Typically the LED is a UV-LED in combination with fluorescent plate to produce white light with a high blue intensity. This results in an improved contrast for yellow patches. Also, the expected lifetime of the LED is considerably longer than that of a filament bulb. This appreciably extends the life of the on-line gloss meter 10 (or time between significant service calls for light source replacement). It is further noted that, when a regular LED is imaged onto a surface, the electrode of the LED would show. However, the electrode of the LED 40 is not visible when the light beam is emitted by the fluorescent plate. Furthermore, the optics (lens 50*a*) is mounted in and integrated into a tube formed by the elements 57, 58, with a blackened interior surface 57*a* so that an almost collimated light beam is produced from the emission by the LED. Circular apertures 56 are used instead of square ones (the DIN norm) since they are cheaper and easier to make, with good accuracy.

Figure 3B:
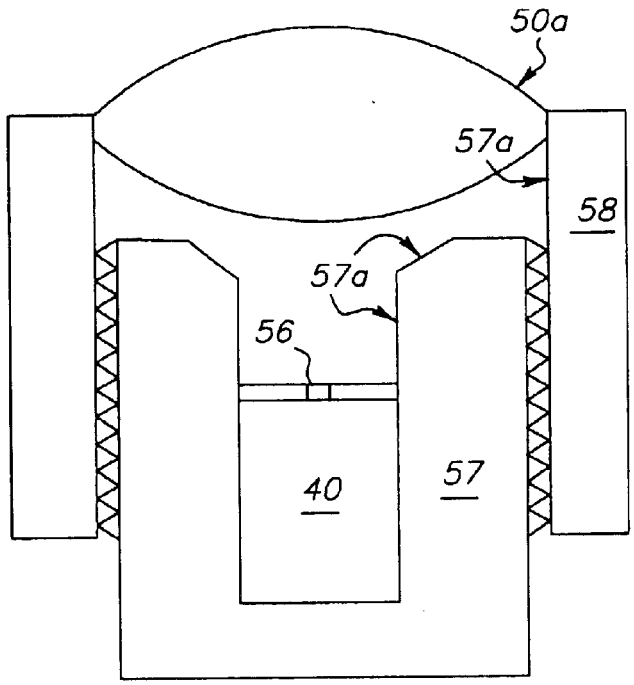

In the light collectors 18*a*, 18*b*, reflected light (e.g., beams 17*a*, 17*b*) is collected by a planoconvex lens 50*b* (see FIG. 3*b*) for optimal focusing. The collected light is detected by a suitable photodiode, designated by the numeral 52 (for example by a Siemens BPW21 photodiode having a built-in Vλ filter), in order to best simulate the spectral response of the human eye. The photodiode 52 is mounted at the end of a tube formed by the elements 54, 55 that have a blackened interior surface 54*a*. The threaded interface between the elements 54 and 55 serves to enable the photodiode 52 to be accurately positioned exactly in the focus of the lens 50*b*. It is also noted that a circular aperture 51 is provided for the photodiode, for the same reasons as discussed above with regard to aperture 56.

Figure 6:
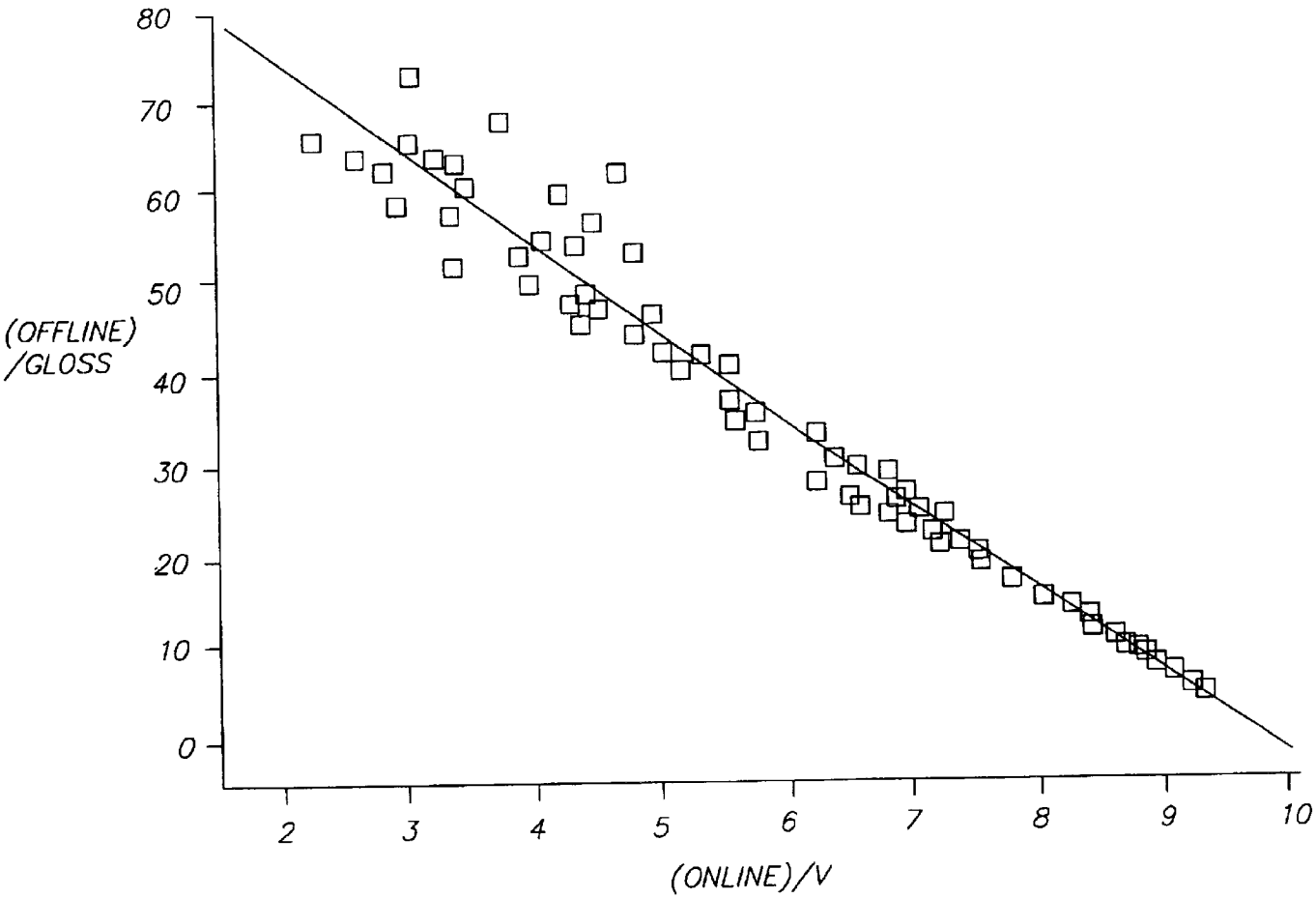
FIG. 6 is a calibration chart of on-line gloss/density meter read out, with respect to a conventional table top (off-line) gloss meter detection value.

The output from the on-line gloss/density meter 10 is measured in volts which is calibrated to standard gloss units with respect to any well known off-line, table-top device such as the MicroTriGloss, available from BYK-Gardner (see FIG. 6, which is as an example, calculated at a reflection angle of 60°). The gloss/density measurements in accordance with this invention are done on the samples in real time (i.e., on-line) after the fusing step in the electrographic reproduction process. The output is stored in the logic and control unit L of the reproduction apparatus (or in a dedicated self-contained logic and control unit) and used for image quality analysis or other reproduction apparatus control functions.

In the operation of the on-line gloss/density meter 10 according to this invention, when there is no receiver member (e.g., paper substrate) inside the measuring zone of the transport path P (i.e., visible through the guide opening 30*a*), the LED 40 of an emitter 12*a* (or emitters 12*a* and 12*b*) of the on-line gloss/density meter illuminate the blank bronze leaf spring 32 (see FIG. 1). This produces a high signal in the collector 18*a* (or collectors 18*a* and 18*b*). As soon as a receiver member enters the measuring zone, the reflected light signal produced at the collector is reduced. It should be pointed out that as a result of the arrangement for this on-line gloss/density meter 10, this arrangement can also clearly be used as a sheet detector.

Continuing with the explanation of the operation of the on-line gloss/density meter 10 when, a colored patch on a receiver member is illuminated by the on-line gloss/density meter, the reflected light signal detected at the collector changes. This makes it possible to readily recognize individual test patches as the receiver member travels through the measurement zone. It should, of course, be noted that in the case where the gloss of the patches matches the gloss of the receiver member exactly, then the described triggering scheme will fail. However, at this stage the ideal gloss match case has been reached anyway, and no adjustments of the reproduction apparatus control functions are necessary.

With the preferred arrangement, the gloss of the fused images along with that of the receiver member is measured on-line after the fusing step in an electrographic process reproduction apparatus using the on-line gloss/density meter 10 according to this invention as described. The gloss values are fed to the reproduction apparatus logic and control unit L through a feedback loop (see FIG. 1 and circuit diagram of FIG. 4). The gloss values of the marking particle image and the receiver member are compared to a reference value by the microprocessor based logic and control unit L of the reproduction apparatus. The logic and control unit L then can be utilized to effect adjustment of the reproduction apparatus fusing parameters accordingly, i.e., by calculation or by using look-up tables stored in the logic and control unit. For example, the fuser nip-width is a fairly easy and quick fusing parameter to control through any suitable mechanical mechanism such as for example a cam arrangement (not shown). The fuser temperature is another fuser parameter, which may be readily adjusted; however, temperature adjustment takes somewhat longer to stabilize. These above-mentioned fusing parameters could be used either individually or in combination as the situation demands (depending on the paper thickness, weight, and job length), to control or correct gloss after receiving the information of the gloss level from the from the on-line gloss/density meter 10.

The signals generated by the light reflection arrangement of emitter 12*b* and collector 18*b* at approximately 60° from opposite sides of the vertical (see FIGS. 2*a*, 2*b*, 2*c*) are governed by the pure gloss (specular) light reflection contribution of the marking particle and receiver member. On the other hand, the influence of the marking particle density is the primary signal influencing factor for the arrangement of the emitter 12*a* and collector 18*a* at approximately 20° from opposite sides of the vertical (see FIG. 2*a*), and larger angle geometry arrangements (for example, up to approximately the 45°/45° arrangement shown in FIG. 2*b*), or in geometries insensitive to specular reflection such as the 45°/0° arrangement of FIG. 2*c*. Accordingly, it is also possible to use a 45° or less geometry arrangement of the on-line gloss/density meter 10 to get reflected light information on-line from the fused images, convert that information into appropriate signals, and feedback such signals of that information to the logic and control unit L to do marking particle coverage corrections for required density outputs. This alternative geometry employed by the on-line gloss/density meter 10 with white LED illumination enables continuous measurement, integration and significantly reduced cycle times required by real-time measurement.

As shown in FIGS. 2*a*, 2*b*, and 2*c*, reflected light outputs from the on-line gloss/density meter, including both 20° and 60° (or other non-specular sensitive) geometry arrangements is accomplished simultaneously. Thus, information can be readily gathered in the above described manner which can be used to correct for the density and gloss, at the same time, using appropriate feedback and control logic (see FIG. 5). Accordingly, using the on-line gloss/density meter 10 of this invention to correct for the density eliminates the need for separate densitometers (which get dirty by the toner dust and thus are generally only marginally reliable) of the electrographic reproduction apparatus.

As described, image gloss is controlled and matched to the receiver member (e.g., paper substrate) as the reproduction job is in process. This is accomplished by on-line (real-time) gloss measurements which result in time saving in completing such job. Accordingly, there is better utilization of data for quality control purposes. In particular, use of fiber optic light pipes (not shown) and attached collimation optics to distribute emitted LED light beams and collect reflected light for detection, enables ready integration of the on-line gloss/density meter 10 in close proximity to the fusing elements, at elevated temperatures, without effecting the ability to accurately measure gloss/density. Therefore, such apparatus is relatively inexpensive and simpler than prior devices. It is thus highly desirable to combine gloss and density measurement to permit compensation for the density component of the gloss measurement.

The invention has been described in detail with particular reference to certain preferred embodiments thereof, but it will be understood that variations and modifications can be effected within the spirit and scope of the invention.

What is claimed is:

1. An on-line gloss/density meter for an electrostatographic reproduction apparatus in which pigmented marking particle images are fixed to receiver members respectively by application of heat and/or pressure as such receiver members travel along a transport path through a fuser assembly, said on-line gloss/density meter comprising:

at least one light emitter for emitting a collimated light beam, said light emitter mounted in operative association with said transport path;

at least one light collector, mounted in operative association with said at least one light emitter and said transport path to detect light from said at least one light emitter, reflected from a receiver member transported along said transport path, and produce a signal corresponding to such reflected light;

a guide element associated with said transport path for directing a receiver member into a predetermined specified location relative to the beam of light from said at least one light emitter to reflect light toward said at least one light collector; and a logic and control unit for controlling operative parameters of said electrostatographic reproduction apparatus, said logic and control unit responsive to signals from said at least one light collector, whereby upon said at least one light collector providing appropriate signals, said logic and control unit precisely controls operating parameters for said electrostatographic reproduction apparatus to control, on-line, gloss and/or density.

2. The on-line gloss/density meter according to claim 1, wherein said light emitter is located substantially immediately downstream, in the direction of receiver member travel, from said fuser assembly.

3. The on-line gloss/density meter according to claim 1, wherein said transport path is defined by flat sheet-metal plates having a suitable opening through which a light beam can be reflected from a receiver member, and said guide element includes an urging member, mounted relative to said flat sheet-metal plates, suitable for urging a receiver member transported along said transport path into a repeatable, accurate, predetermined spacing relative to said opening and said light emitter/light collector.

4. The on-line gloss/density meter according to claim 3, wherein said urging member is a bronze leaf spring.

5. The on-line gloss/density meter according to claim 1, wherein said transport path is defined by wire-form guides having a suitable opening through which a light beam can be reflected from a receiver member, and said guide element includes an urging member, mounted relative to said wire-form guides, suitable for urging a receiver member transported along said transport path into a repeatable, accurate, predetermined spacing relative to said opening and said light emitter/light collector.

6. The on-line gloss/density meter according to claim 5, wherein said urging member is a spring.

7. The on-line gloss/density meter according to claim 5, wherein said urging member is a bronze leaf spring.

8. The on-line gloss/density meter according to claim 1, wherein said at least one light emitter includes a white light LED, and fluorescent plate whereby said collimated light beam is a white light with a high blue intensity, such that contrast for yellow patches on a receiver member is improved.

9. The on-line gloss/density meter according to claim 8, wherein said LED is a UV-LED.

10. The on-line gloss/density meter according to claim 9, wherein optics of said LED is mounted in and integrated with a tube having a blackened interior surface so that, a substantially collimated light beam is produced from the emission by said LED.

11. The on-line gloss/density meter according to claim 8, wherein said florescent plate includes a circular aperture, whereby said aperture is cheaper and easier to make, with good accuracy.

12. The on-line gloss/density meter according to claim 1, wherein said at least one light collector includes a lens and a suitable photodiode mounted adjacent respective ends of a tube formed by elements having a threaded interface which serves to enable said photodiode to be accurately positioned exactly in the focus of said lens, said elements having a blackened interior surface.

13. The on-line gloss/density meter according to claim 12, wherein said photodiode has a built-in $V\lambda$ filter in order to best simulate the spectral response of the human eye.

14. The on-line gloss/density meter according to claim 13, wherein said a circular aperture is provided for said photodiode, whereby said aperture is cheaper and easier to make, with good accuracy.

15. The on-line gloss/density meter according to claim 1, wherein said at least one light emitter and said at least one light collector are respectively oriented at approximately 60° from opposite sides of the vertical so that a signal from said light collector detects specular reflected light corresponding to gloss of a receiver member surface, and said logic and control unit, in response to such signal, controls operative parameters of said fuser assembly to control gloss.

16. The on-line gloss/density meter according to claim 1, wherein said at least one light emitter and said at least one light collector are respectively oriented at approximately 45° or less from opposite sides of the vertical so that a signal from said light collector detects direct reflected light corresponding to density of a marking particle image on a receiver member surface, and said logic and control unit, in response to such signal, controls operative parameters to control density.

17. The on-line gloss/density meter according to claim 1, wherein said at least one light emitter and said at least one light collector are respectively oriented at approximately 45° and approximately 0° from the vertical so that a signal from said light collector detects direct reflected light corresponding to density of a marking particle image on a receiver member surface, and said logic and control unit, in response to such signal, controls operative parameters to control density.

18. The on-line gloss/density meter according to claim 1, wherein a plurality of light emitters and a plurality of light collectors are provided; one light emitter of said plurality of light emitters and one light collector of said plurality of light collectors are respectively oriented at approximately 60° from opposite sides of the vertical so that a signal from said light collector detects specular reflected light corresponding to gloss of a receiver member surface; and another light emitter of said plurality of light emitters and another light collector of said plurality of light collectors are respectively oriented at approximately 45° or less from opposite sides of the vertical so that a signal from said light collector detects direct reflected light corresponding to density of a marking particle image on a receiver member surface; whereby said logic and control unit, in response to such signals, substantially simultaneously controls operative parameters of said fuser assembly to control gloss and operative parameters to control density.

19. With a reproduction apparatus in which pigmented marking particle images are fixed to receiver members respectively by application of heat and/or pressure as such receiver members travel along a transport path through a fuser assembly, the method of controlling, on-line, gloss and/or density comprising the steps of:

emitting a collimated light beam, in operative association with said transport path substantially immediately downstream, in the direction of receiver member travel, from said fuser assembly;

guiding a receiver member in said transport path so as to direct such receiver member into a predetermined specified location relative to the beam of light to reflect light;

detecting light reflected from a receiver member transported along said transport path, and producing a signal corresponding to such reflected light; and responsive to light detection signals, providing appropriate signals, to precisely control operating parameters for said electrostatographic reproduction apparatus to control, on-line, gloss and/or density.

* * * * *